US012082637B2

(12) United States Patent
White et al.

(10) Patent No.: US 12,082,637 B2
(45) Date of Patent: Sep. 10, 2024

(54) NOVELTY HEADWEAR ALLOWING ATTACHMENT OF DECORATIVE ELEMENTS

(71) Applicant: Haul Hats Holdings, Naperville, IL (US)

(72) Inventors: William White, Naperville, IL (US); Carrie Leigh, Denver, CO (US)

(73) Assignee: Haul Hats Holdings, Naperville, IL (US)

( * ) Notice: Subject to any disclaimer, the term of this patent is extended or adjusted under 35 U.S.C. 154(b) by 423 days.

(21) Appl. No.: 16/717,578

(22) Filed: Dec. 17, 2019

(65) Prior Publication Data

US 2021/0177080 A1 Jun. 17, 2021

(51) Int. Cl.
*A42B 1/004* (2021.01)
*A42B 1/248* (2021.01)

(52) U.S. Cl.
CPC ..... *A42B 1/004* (2013.01); *A42B 1/248* (2013.01)

(58) Field of Classification Search
CPC ..... A42B 1/004; A42B 1/205; A42B 1/24; A42B 1/241; A42B 1/242; A42B 1/248
See application file for complete search history.

(56) References Cited

U.S. PATENT DOCUMENTS 5,740,557 A * 4/1998 Reid ..... A42B 1/248 2/195.1
5,996,116 A * 12/1999 Tate ..... A42B 1/24 2/12
6,163,889 A * 12/2000 Tate ..... A42B 1/24 2/209.13
6,170,088 B1 * 1/2001 Tate ..... A63B 57/50 2/209.13
6,175,963 B1 * 1/2001 Loeffelholz ..... A43B 23/24 2/209.13
6,692,427 B2 2/2004 Bove
7,187,261 B2 3/2007 Cassar
8,516,621 B2 8/2013 Woolery
9,914,615 B2 3/2018 Wooldridge
2006/0016841 A1 1/2006 Shurm
2013/0126541 A1 5/2013 Woolery
2014/0013493 A1 * 1/2014 Blunt ..... A42B 3/04 2/422
2014/0063443 A1 * 3/2014 Berger ..... A42B 1/247 351/155
2014/0266526 A1 9/2014 Swift, Jr.
2020/0404997 A1 * 12/2020 Davis ..... A42B 1/248

OTHER PUBLICATIONS

Definition of "patch" (Year: 0000).*

* cited by examiner

*Primary Examiner* — Sally Haden
(74) *Attorney, Agent, or Firm* — NIXON PEABODY LLP

(57) ABSTRACT

A headwear system that allows changing the outward appearance of headwear such as a cap is disclosed. The system includes a fabric head covering having a securing mechanism on an interior surface of the fabric. A utility belt is inserted in the securing mechanism. The utility belt has a magnet. A decorative element having a ferrous material is attached to an exterior area of the headwear corresponding to a location of the magnet of the utility belt on the interior surface of the fabric head covering.

15 Claims, 7 Drawing Sheets

NOVELTY HEADWEAR ALLOWING ATTACHMENT OF DECORATIVE ELEMENTS

TECHNICAL FIELD

The present disclosure relates generally to headwear, and more specifically to a cap that allows removable decorative items to be attached at different location on the cap to change the appearance of the cap.

BACKGROUND

Embroidered patches and decorative accessories such as golf ball markers for golf themed caps are popular elements of sports caps or hats and have been used for many years. Most embroidered caps have permanent decorative elements that are sewn or otherwise adhered to the exterior of the cap. This requires the purchase multiple caps in order to wear caps of different decorations.

Certain solutions have been proposed to increase the flexibility of a single cap to show different decorative elements. For example, various pins may be offered that may be stuck into a cap. However, such pins are often limited in size and may damage the cap if they are moved often. Tactical caps use Velcro as an attachment mechanism to provide a user with the ability to change patches. However, tactical caps are tied to the placement of a Velcro footprint pre-sewn onto the cap for attaching the decorative items. Thus, the appearance of the cap is fixed by the placement of the Velcro footprint(s) as decorative items may only be attached to the areas with the Velcro footprint.

There is a need for a cap that includes the ability to place decorative items in different locations. There is also a need for headwear having a pocket for a utility belt for holding different decorative icons. There is also a need for headwear that includes the ability to make removable decorative items appear to be permanently attached to the headwear.

SUMMARY

One disclosed example is a headwear system. The headwear system includes a fabric head covering having a securing mechanism on an interior surface of the fabric. A utility belt is inserted in the securing mechanism. The utility belt has a magnet. A decorative element having a ferrous material is provided. The decorative element is attached to an exterior area of the head covering by the magnet of the utility belt, corresponding to a location of the magnet.

Another disclosed example is a cap with a selectable appearance. The cap includes a fabric material having an exterior surface and an interior surface. A utility belt having a plurality of magnets arranged in a pattern is provided. The utility belt is attached to the interior surface under a side and a front of the cap. A first decorative element, having a ferrous material, is attachable on the exterior surface of the fabric material on the side or the front of the cap via any one of the plurality of magnets The above summary is not intended to represent each embodiment or every aspect of the present disclosure. Rather, the foregoing summary merely provides an example of some of the novel aspects and features set forth herein. The above features and advantages, and other features and advantages of the present disclosure, will be readily apparent from the following detailed description of representative embodiments and modes for carrying out the present invention, when taken in connection with the accompanying drawings and the appended claims.

BRIEF DESCRIPTION OF THE DRAWINGS

The disclosure will be better understood from the following description of exemplary embodiments together with reference to the accompanying drawings, in which.

Figure 1A:
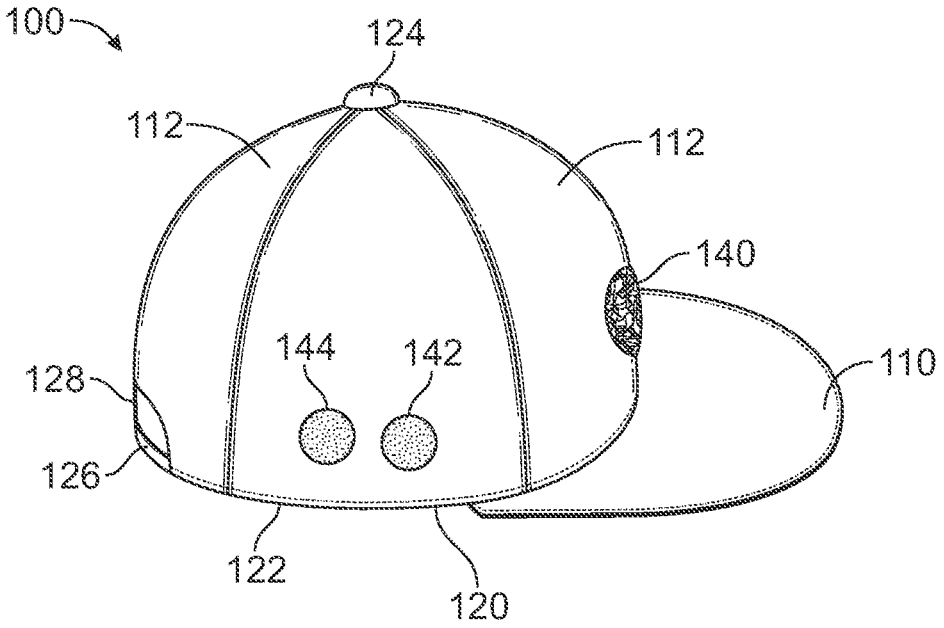
FIG. 1A is a perspective side view of an example cap with attached decorative items.

The present disclosure is susceptible to various modifications and alternative forms. Some representative embodiments have been shown by way of example in the drawings and will be described in detail herein. It should be understood, however, that the invention is not intended to be limited to the particular forms disclosed. Rather, the disclosure is to cover all modifications, equivalents, and alternatives falling within the spirit and scope of the invention as defined by the appended claims.

DETAILED DESCRIPTION OF THE ILLUSTRATED EMBODIMENTS

The present inventions can be embodied in many different forms. Representative embodiments are shown in the drawings, and will herein be described in detail. The present disclosure is an example or illustration of the principles of the present disclosure, and is not intended to limit the broad aspects of the disclosure to the embodiments illustrated. To that extent, elements and limitations that are disclosed, for example, in the Abstract, Summary, and Detailed Description sections, but not explicitly set forth in the claims, should not be incorporated into the claims, singly or collectively, by implication, inference, or otherwise. For purposes of the present detailed description, unless specifically disclaimed, the singular includes the plural and vice versa; and the word "including" means "including without limitation." Moreover, words of approximation, such as "about," "almost," "substantially," "approximately," and the like, can be used herein to mean "at," "near," or "nearly at," or "within 3-5% of," or "within acceptable manufacturing tolerances," or any logical combination thereof, for example.

The present disclosure relates to a method of changing the external appearance of headwear via replaceable decorative elements attached to the headwear through magnetic force. A magnetic utility belt is inserted into an interior securing mechanism of a cap. The utility belt provides structure and a method of attachment for decorative elements such as patches, markers, and other exterior elements. Exterior elements such as patches and markers remain in position on the headwear through magnetic attraction between the magnetic utility belt and ferrous elements on the decorative element.

The present decorative system for a cap or other headwear includes an interior utility belt on the interior of the cap and external decorative elements that may be affixed to the front or sides of the cap. Magnetic force joins the decorative elements to the utility belt through the material of the cap. To create the utility belt, magnets are placed on a neoprene foam material and encased with heat applied material such as vinyl. External decorative elements such as patches are created by adhering a flexible ferrous material between fabric layers. The external decorative elements may therefore be placed in different areas of the cap backed by the utility belt.

The example interchangeable decoration system allows the display of multiple surface embellishments on a cap. The attachment system is an improvement to existing cap decorations via its flexible magnetic canvas upon which users may remove and replace decorative elements of different designs, shapes, and locations. Embellishments remain in place through magnetic force along a template of strong magnets. The foam utility belt insert has multiple magnets in an array to allow attachment of decorative elements on a larger surface area in comparison to traditional embroidered headwear and tactical hats. The utility belt is stabilized by an interior pouch in the cap. Decorative elements may be removed and interchanged from the cap by the user.

Figure 1B:
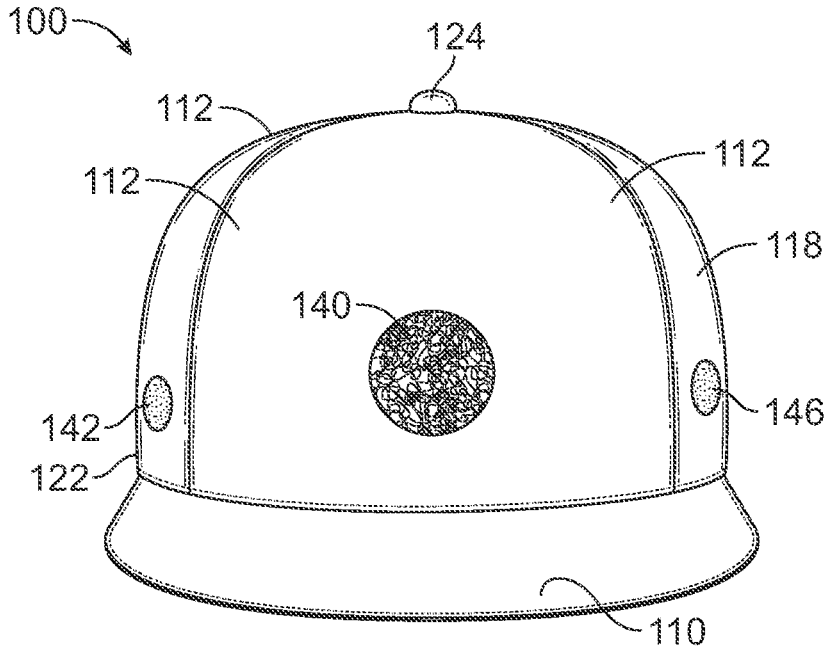
FIG. 1B is a front view of the example cap in FIG. 1A.

FIGS. 1A-1B show perspective views of a decorative headwear article which may be a cap 100. Specifically, FIG. 1A is a perspective side view of an example cap 100 with attached decorative items and FIG. 1B is a front view of the example cap 100 in FIG. 1A. As will be explained the appearance of the cap 100 may be altered via the placement of the decorative items and the attachment of different decorative items.

The cap 100 includes decorative items that may be placed in different exterior surfaces of the cap 100. The cap 100 includes a brim 110, and multiple triangular panels 112. The panels 112 may be constructed from any appropriate natural or synthetic fabric material such as twill. The panels 112 are each sewn to each other via seams on respective lateral angled sides. A side between the lateral angled sides forms a generally circular open end 120 defined by a bottom rim 122. An interior semi-circular sweat band 123 backs the rim 122 at the open end 120. The ends of the rim 122 on the opposite end of the brim 110 are attached to straps 126 and 128. In this example, the strap 126 has holes and the strap 128 has matching pins that allow them to be attached each other in an adjustable fashion in order to adjust the circumference of the open end 120 to accommodate different head sizes. A proximal end of each of the panels 112 are joined at a button 124 that defines the top of the cap 110. The brim 110 is attached to a front end of the cap 100 as defined by the panels 112 in the front.

Different decorative items may be attached to the exterior of the cap 100 as defined by the panels 112. For example, FIGS. 1A-1B show four decorative items 140, 142, 144 and 146 attached to the cap 100. The decorative items 140, 142, 144 and 146 may be of any desirable size or shape. The decorative items 140, 142, 144 and 146 are ferrous-infused and attached to the front and sides of the cap 100 as a user desires and retained by magnetic force. Although four decorative items are shown in FIG. 1A, it is to be understood that any number of decorative items may be affixed to the cap 100. The decorative items give the appearance that they are permanent parts of the cap 100. In this example, the decorative item 140 is attached in the center of the front of the cap 100 above the brim 110. The decorative items 142 and 144 are attached on the panel 112 on one side of the cap 100. The decorative item 146 is attached on the panel 112 on the opposite side of the cap 100 as shown in FIG. 1B. As will be explained below, the decorative items, such as the decorative items 140, 142, 144, and 146, may be fixed in place but may also be replaced or moved around to alter the appearance of the cap 100.

Figure 2A:
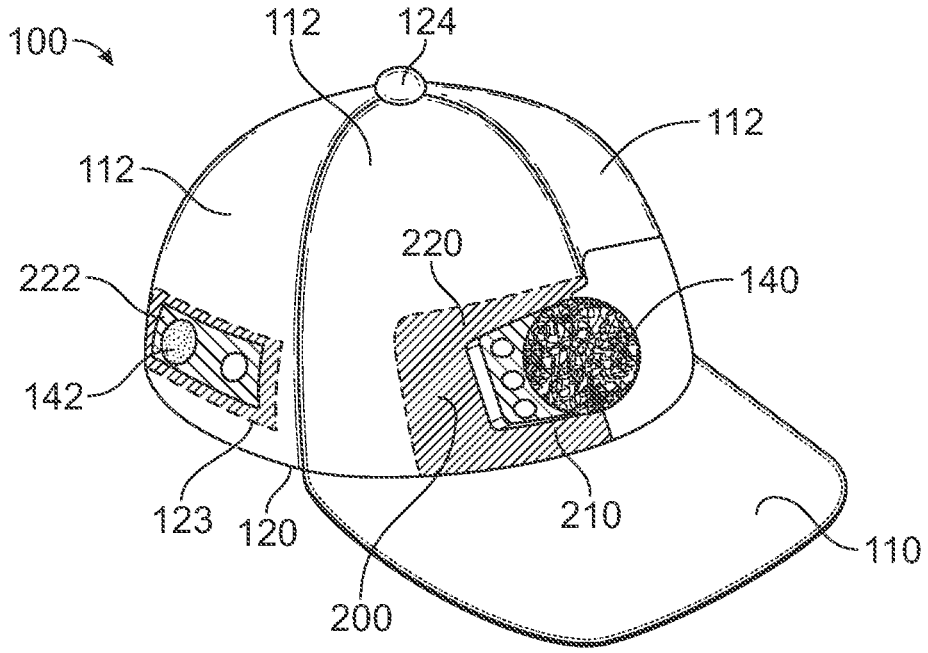
FIG. 2A is a front perspective, partial cutaway view of the example cap in FIG. 1A with an inserted utility belt to hold decorative items.
Figure 2B:
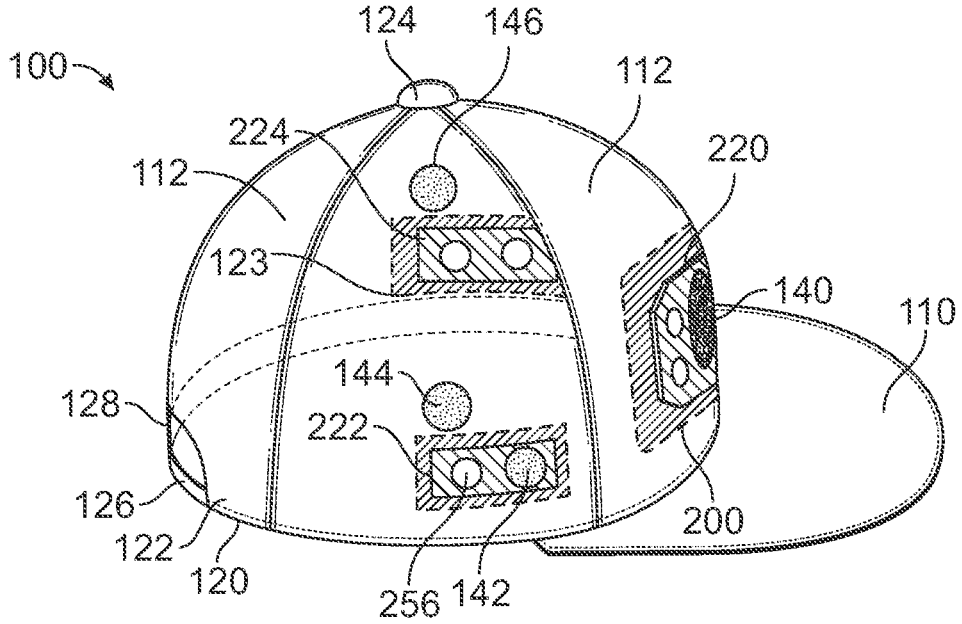
FIG. 2B is a side perspective, partial cutaway view of the example cap in FIG. 1A.
Figure 2C:
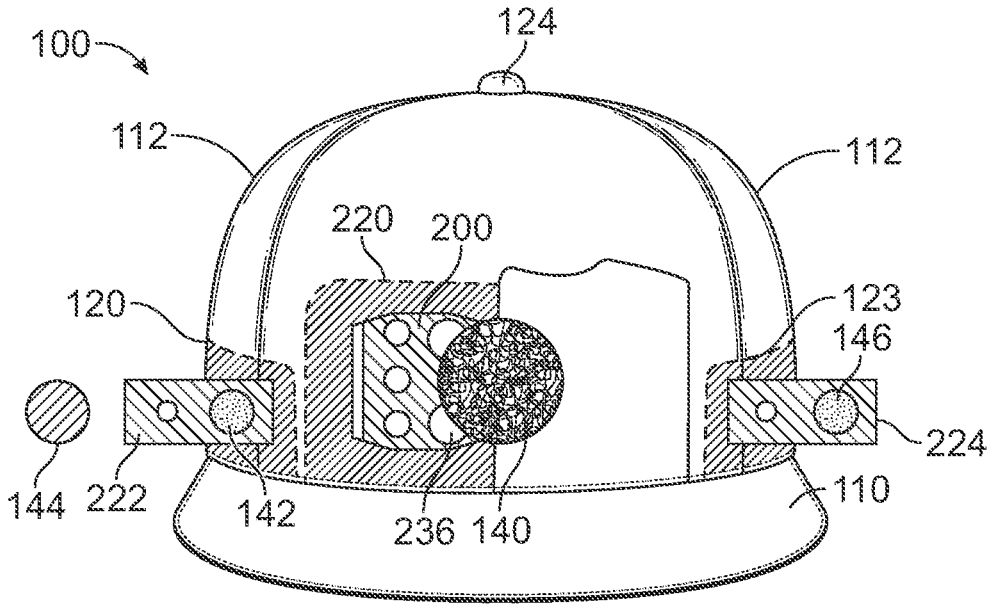
FIG. 2C is a front partial cutaway view of an example cap in FIG. 1A with the inserted utility belt to hold decorative items.
Figure 2D:
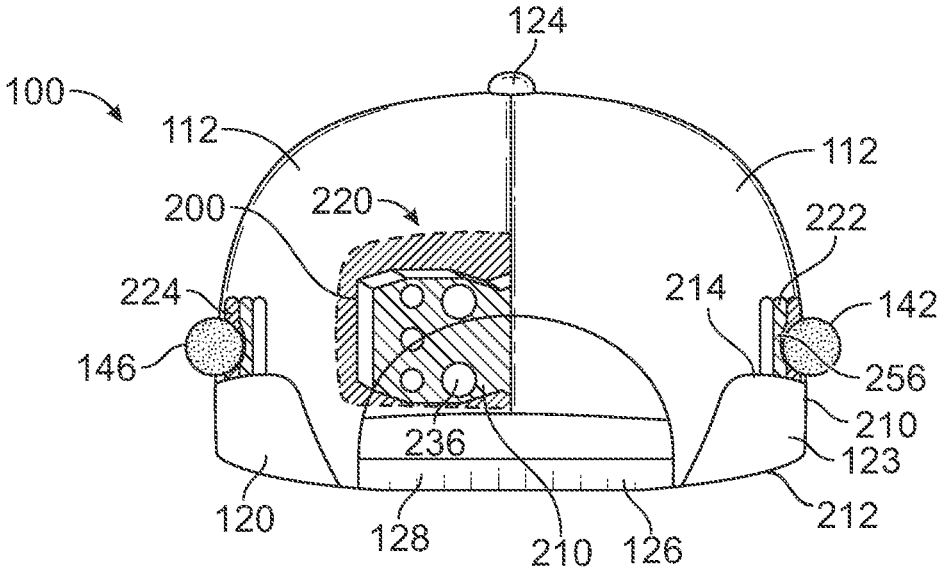
FIG. 2D is a back partial cutaway view of an example cap in FIG. 1A with the inserted utility belt to hold decorative items.

FIGS. 2A-2D show partial cutaway views of the cap 100 that show an embedded utility belt 200 that serves to fix decorative items such as decorative items 140, 142, 144, and 146 in place as shown in FIG. 1A. FIG. 2A is a front perspective, partial cutaway view of the example cap 100 in FIG. 1A with the inserted utility belt 200 to hold decorative items. FIG. 2B is a side perspective, partial cutaway view of the example cap 100. FIG. 2C is a front partial cutaway view of an example cap 100 in with the inserted utility belt 200 to hold decorative items. FIG. 2D is a back partial cutaway view of an example cap 100 with the inserted utility belt 200 to hold decorative items.

A securing mechanism such as an interior pouch 210 is formed behind the front panels 112 of the cap 100. The pouch 210 may be part of the sweat band 123 and thus encircles the sides and the front of the cap 100. Other structures may hold the utility belt 200 such as a belt loop structure. A bottom closed edge 212 of the pouch 210 is attached to the front panels 112. As shown in FIG. 2D, the utility belt 200 is inserted in an open end 214 of the pouch 210 between the interior of the pouch 210 and the interior of the panels 112. The utility belt 200 is thus held in place by the interior pouch 210 and the interior surfaces of the panels 112. Other devices such as interior loops may be used to secure the utility belt 200.

The utility belt 200 slides into the interior of the cap 100 and rests in the pouch 210 that is connected to the sweat band 123 of the cap 100. From a rear view, the bottom foam layer of the utility belt 200 faces the user's forehead. Thus, the utility belt 200 sits behind the front of the cap 100 and wraps around each side. The utility belt 200 thus is concealed by the panels 112. Decorative items such as the decorative items 140, 142, 144, and 146 that have ferrous material magnetically adhere to the utility belt 200 through magnetic force.

Figure 3:
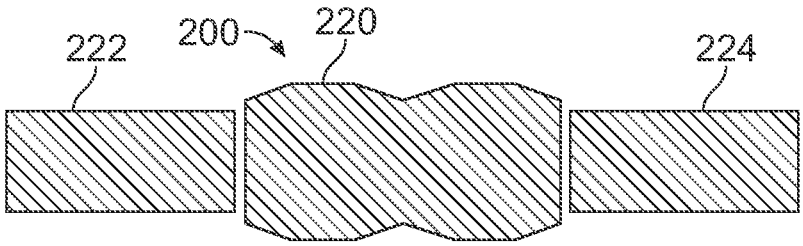
FIG. 3 is a front view of the utility belt in FIG. 1.

FIG. 3 is a front view of the utility belt 200. As may be seen in FIGS. 2A-2D and FIG. 3, the utility belt 200 includes a center piece 220 and two side pieces 222 and 224. In this example, the center piece 220 rests behind the front of the cap 100 and has a greater height than the side pieces 222 and 224 that each extend at the level of the sweatband 123. The side pieces 222 and 224 are rectangular shaped in this example. The decorative items may be attached to exterior of the cap in any exterior area that is backed by any of the pieces 220, 222 and 224 of the utility belt 200.

Figure 4A:
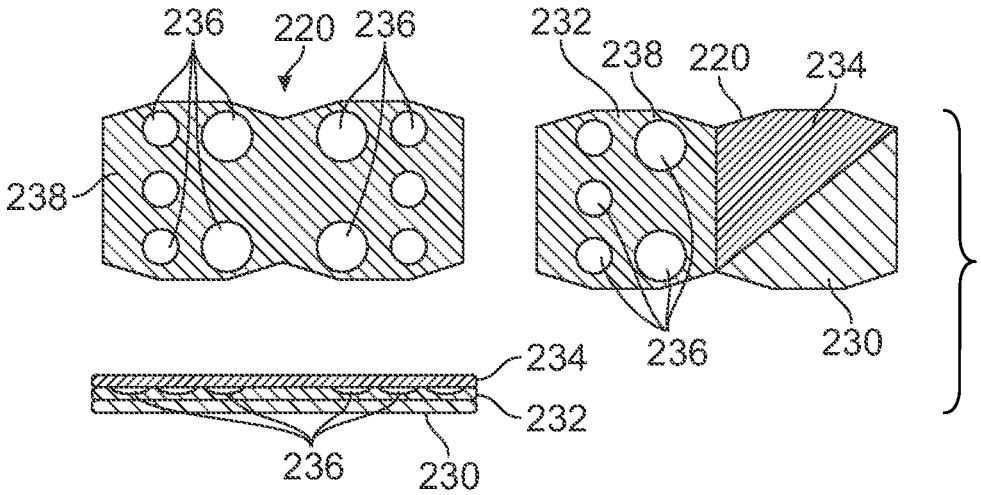
FIG. 4A shows different sectional views of the main component of the utility belt in FIGS. 2A-2D.
Figure 4B:
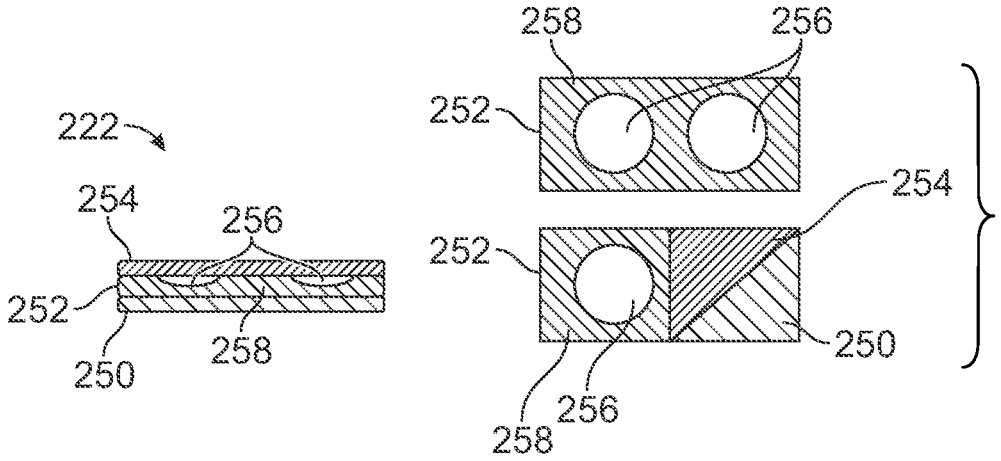
FIG. 4B shows different sectional views of the side components of the utility belt in FIGS. 2A-2D.

FIG. 4A are sectional views of the center piece 220 of the utility belt 200. FIG. 4B are sectional exploded view of the components of the side piece 222. In this example, the center piece 220 of the utility belt 200 is shown in FIG. 4A broken up in the different layers. The center piece 220 includes a backing layer 230, a magnet array 232 and a sealing layer 234. The backing layer 230 in this example is a pliant material such as fabric, foam or neoprene. The backing layer 230 is closest to the head of the wearer, and is thicker than other fabric layers to provide a cushion for the utility belt 200. The magnet array layer 232 is attached to the backing layer 230 and supports a series of magnets 236. The magnet array layer 232 in this example, includes a foam material 238 having the magnets 236 placed in a pattern to accept a variety of shapes and sizes of decorative elements. The sealing layer 234 in this example, is a plastic sealant (e.g. heat transfer vinyl) that permanently holds the magnets 236 in their designated array pattern on the foam material 238 of the magnet array layer 232, when the sealing layer 234 is heat treated. When heated, the sealing layer 234 is caused to adhere to the foam 238. In this example, the magnets 236 are 1/16" thick and the neoprene material of the backing layer 230 is of similar thickness. In this example, the magnets 236 may be between 1/8" and 1/16" thick.

Similarly, as shown in FIG. 4B, the side piece 222 includes a backing layer 250, a magnet array 252 and a sealing layer 254. The backing layer 250 in this example is a pliant material such as fabric, foam or neoprene. The backing layer 250 is closest to the head of the wearer, and is thicker than other fabric layers to provide a cushion for the utility belt 200. The magnet array layer 252 is attached to the backing layer 250 and supports different magnets 256. The magnet array layer 252 in this example, includes a foam material 258 having magnets 256 placed in a pattern to accept a variety of shapes and sizes of decorative elements. The sealing layer 254 in this example, is a plastic sealant (e.g. heat transfer vinyl) that permanently holds the magnets 256 in their designated array pattern on the foam 258 of the magnet array layer 252. The materials of the backing layer 250, magnet array layer 252, and the sealing layer 254 are similar to their counterparts in the center piece 220. The side piece 224 is of identical construction and materials as the side piece 222 shown in FIG. 4B. In this example, the layers of the side pieces 222 and 224 are fabricated in one piece with the layers of the center piece 220.

Figure 5A:
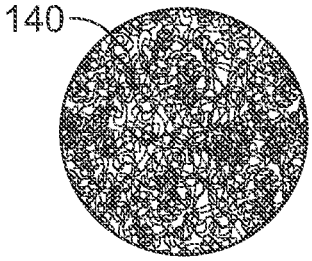
FIG. 5A is a close-up view of an example decorative item from FIG. 1A.
Figure 5B:
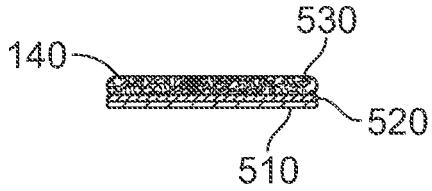
FIG. 5B is a sectional view of the example decorative item in FIG. 5A.
Figure 5C:
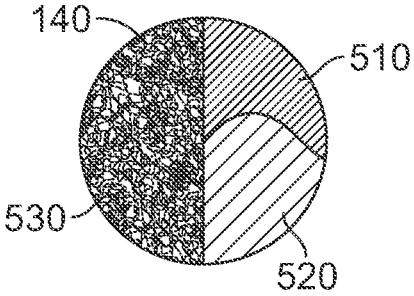
FIG. 5C is a layer cutaway view of the example decorative item in FIG. 5A.

FIGS. 5A-5C detail the sections of a decorative item such as the decorative element 140. FIG. 5A is a close up view of the decorative item 140. FIG. 5B is a cross section view of the decorative item 140. FIG. 5C is a sectional partial cutaway view of the layers of the decorative item 140. The decorative element 140 in this example is a decorative ferrous patch. The other elements 142, 144, and 146 in FIG. 1A are smaller in size, but have similar layers as will be described below in relation to the decorative item 140. The decorative item 140 is constructed having a bottom layer 510, a flexible ferrous sheet 520 in the same shape in the middle, and a decorated front layer 530. The bottom layer 510 is constructed of fabric or similar material is lightweight and thin to minimize the magnetic pull required for the ferrous decorative object to remain in place on the exterior of the cap 100. The front layer 530 may be decorated with embroidery, digital print, screen print, or other decoration method. The layer 510, ferrous sheet 520, and front layer 530 are held together either by the front embellishment (e.g. heat transfer vinyl), bonding fabric, or other fabric adhesive. Other methods and mechanisms may be used to join the layers of the decorative element 140.

The system incorporates strong magnets permanently affixed in a pattern inside a foam insert 238 in the magnet array layers 232 of the utility belt 200. The decorative elements contain a critical mass of ferrous material in order to adhere to the magnets 236 or 256 under the exterior of the cap 100 through the weight of the fabric of the cap 100. Different sized decorative elements may be attached to like sized magnets in the utility belt 200. For example, as shown in FIG. 2A, the decorative element 142 is attached to the position of one of the magnets 256 embedded in the side piece 222 of the utility belt 200. Alternatively, larger decorative elements may be attached to multiple magnets in the utility belt 200. For example, the decorative element 140 is a larger patch shape than the smaller decorative element 142 and as shown in FIG. 2C-2D, is attached to four magnets 236 in the center piece 220 of the utility belt 200. The decorative elements are secured in position and retained by magnetic pull of the strong magnets encased in the interior utility belt 200. The utility belt 200 is concealed on the inside of the cap 100 and out of view.

Machinery ensures positive placement of the magnets 236 and 256 in a predetermined array on the foam layers 238 and 258 in FIGS. 4A-4B. The magnetic array layers 232 and 252 allows decorative items such as patches to be displayed in centered and planned positions according to the size and shape of the patch. The platen in manufacturing equipment accounts for the location of the magnets 236 and 256 on the utility belt 200 to avoid reaching levels of heat that may impact the strength of magnetic pull during the production process.

By utilizing the above described cap 100 and utility belt 200, patches and other ferrous elements will adhere to the front and sides of a hat and are held in place by the force of magnetic attraction with a sufficient strength so as to remain attached despite the cap material construction and normal movement while wearing the cap 100. Decorative patches remain stabilized in place through magnetic attraction until a user pulls the decorative item from the cap 100 at a force strong enough to clear the magnetic field. Thus, a user may change the appearance of the cap 100 by replacing some or all of the decorative elements, moving the location of some or all of the decorative elements, or adding or taking off some or all of the decorative elements.

Different sets of decorative elements may be provided to allow the cap 100 to be used for branding or other purposes. For example, a golf company may provide the cap 100 where the decorative patch 140 at the front of the cap 100 in FIG. 1A-1B is the logo of the company. The other decorative elements 142, 144 and 146 may be graphics of golf related items such as a golf ball, a golf club and a pin flag.

The appearance of the cap 100 may be changed by providing another set of decorative elements with a different common theme. Further, the appearance of the cap 100 may also be changed by changing the locations of the decorative elements. For example, the cap 100 with the decorative elements 142, 144, and 146 may be altered with the addition of another decorative element. Alternatively, the appearance of the cap 100 with the decorative elements 142, 144, and 146 may be altered with another patch that replaces the decorative logo patch 140.

Figure 6A:
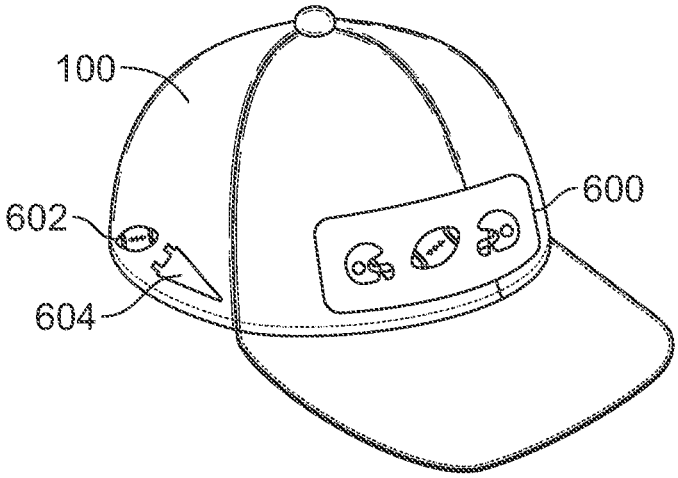
FIG. 6A is a perspective view of the example cap in FIG. 1A with different decorative elements to create a different appearance.

FIG. 6A shows a perspective view of the cap 100 with a different set of decorative elements 600, 602, and 604. Each of the decorative elements 600, 602, and 604 have ferrous material and are attached to the utility belt 200 to replace other decorative elements such as the decorative elements 140, 142, 144 and 146. The decorative elements 600, 602, and 604 all relate to a football theme. In this example, the element 600 is a logo patch and attached to the front of the cap 100. The decorative elements 602 and 604 represent different items (e.g., a pennant and a football) that relate to the general theme. Thus, the appearance of the cap 100 in FIG. 6A differs from the cap in FIGS. 1-2.

Figure 6B:
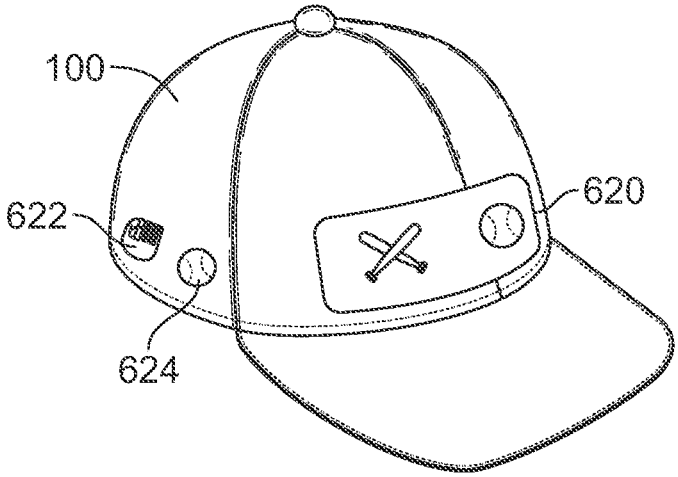
FIG. 6B is a perspective view of the example cap in FIG. 1A with different decorative elements than those in FIG. 6B to create yet another different appearance.

FIG. 6B shows a perspective view of the cap 100 with a different appearance, as the decorative elements 600, 602, and 604 have been replaced with elements 620, 622, and 624. Each of the decorative elements 620, 622, and 624, have ferrous material and are attached to the utility belt 200. The cap 100 now has a different appearance than that shown in FIG. 6A or FIG. 1A as the decorative elements 620, 622, and 624 relate to another theme such as baseball.

Figure 7A:
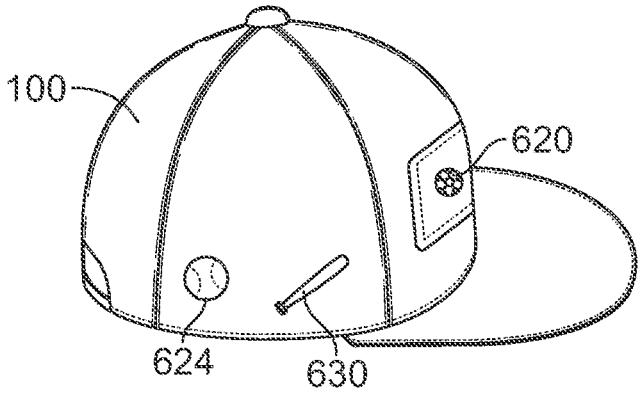
FIG. 7A is a back perspective view of the example cap in FIG. 6A with the addition of another decorative element to change the appearance of the cap 100.

As explained above, the decorative elements may be moved, replaced or other decorative elements may be added to the cap 100 to change the appearance of the cap 100. FIG. 7A is a back perspective view of the cap 100, where the decorative item 622 has been removed and the decorative item 624 has been moved to the position where the decorative item 622 was attached. Further, an additional decorative element 630 has been added to a location next to the decorative item 624.

Figure 7B:
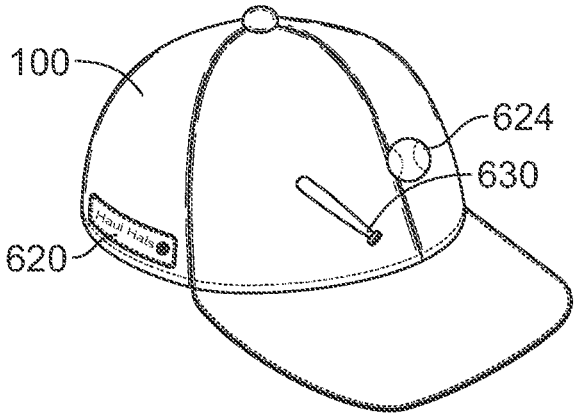
FIG. 7B is a front perspective view of the example cap in FIG. 7A with the decorative elements rearranged to change the appearance of the cap 100.

FIG. 7B is a front perspective view of the cap 100 with a different appearance created by rearranging the decorative elements 620, 624 and 630 in FIG. 7A. In this example, the decorative element 620 (the logo patch) has been moved to the side of the cap 100. The decorative elements 624 and 630 have been attached to the front of the cap 100.

Figure 7C:
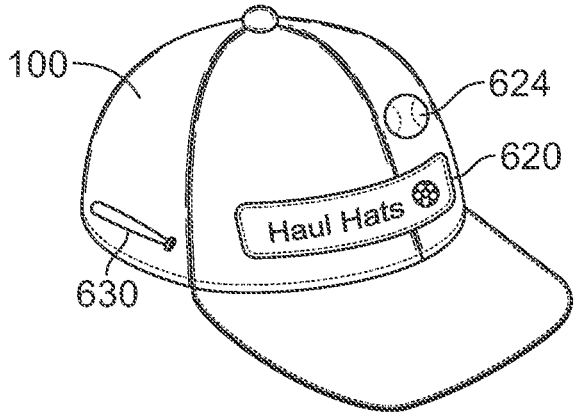
FIG. 7C is a front perspective view of the example cap in FIG. 7B with the decorative elements rearranged to change the appearance of the cap 100.

FIG. 7C is a front perspective view of the cap 100 with another different appearance created by rearranging the locations of the decorative elements 620, 624 and 630 in FIG. 7B. In this example, the decorative element 620 (the logo patch) has been moved to the front of the cap 100. The decorative element 624 has also been attached to the front of the cap 100, while the decorative element 630 remains at the side of the cap 100.

The utility belt 200 may be used with a known cap such as a baseball cap and allow decorative elements to be attached to the exterior of the cap. For example, the utility belt 200 may be inserted in a sweat band on the interior of a normal cap. Alternatively, the utility belt 200 may be attached to the interior of a normal cap by means of connection mechanisms such as straps, tape or similar devices.

The terminology used herein is for the purpose of describing particular embodiments only, and is not intended to be limiting of the invention. As used herein, the singular forms "a," "an," and "the" are intended to include the plural forms as well, unless the context clearly indicates otherwise. Furthermore, to the extent that the terms "including," "includes," "having," "has," "with," or variants thereof, are used in either the detailed description and/or the claims, such terms are intended to be inclusive in a manner similar to the term "comprising."

The term fabric, as used herein, is to be construed in its broadest sense of any thin, expansive, flexible, or supple material of the type typically utilized in the construction of apparel and decorative arts such as embroidery.

The term vinyl applies to heat transfer vinyl, decorative vinyl, and other flexible, thin, expansive materials such as plastic sheet material.

The term foam applies to neoprene, rubber, silicone, felt, and other flexible cast materials.

The ferrous material may be a flexible sheet or infused layer of fabric, rubber, or flexible metal.

Unless otherwise defined, all terms (including technical and scientific terms) used herein have the same meaning as commonly understood by one of ordinary skill in the art. Furthermore, terms, such as those defined in commonly used dictionaries, should be interpreted as having a meaning that is consistent with their meaning in the context of the relevant art, and will not be interpreted in an idealized or overly formal sense unless expressly so defined herein.

While various embodiments of the present invention have been described above, it should be understood that they have been presented by way of example only, and not limitation. Although the invention has been illustrated and described with respect to one or more implementations, equivalent alterations and modifications will occur or be known to others skilled in the art upon the reading and understanding of this specification and the annexed drawings. In addition, while a particular feature of the invention may have been disclosed with respect to only one of several implementations, such feature may be combined with one or more other features of the other implementations as may be desired and advantageous for any given or particular application. Thus, the breadth and scope of the present invention should not be limited by any of the above described embodiments. Rather, the scope of the invention should be defined in accordance with the following claims and their equivalents.

What is claimed is:

1. A headwear system, the system comprising:

a fabric cap head covering having a front panel, two side panels, and a securing mechanism on an interior surface of the fabric cap behind the front panel and the two side panels, wherein the securing mechanism is a pouch having an open end;

a utility belt configured to be inserted in the open end of the pouch of the securing mechanism between the pouch and the interior surface of the fabric cap head covering, the utility belt having a center panel backing the front panel of the fabric cap head covering, the center panel including a first magnet, and two side panels backing the side panels of the fabric cap head covering, one side panel including a second magnet, separate from the first magnet, and the other side panel including a third magnet, each of the center and side panels having a solid sealing layer, a backing layer and a magnet array layer between the solid sealing layer and backing layers, the magnet array layer holding the first, second and third magnets; and a decorative element having a ferrous material, the decorative element being attached to an exterior area of the fabric cap head covering by the first, second or third magnet of the utility belt, corresponding to a location of the first, second or third magnet.

2. The headwear system of claim 1, wherein the utility belt includes a plurality of magnets arranged in a pattern, wherein the first, second and third magnets are each one of the plurality of magnets.

3. The headwear system of claim 2, wherein the decorative element is one of a plurality of decorative elements, each of the plurality of decorative elements attached on the exterior area of the head covering corresponding to one of the plurality of magnets.

4. The headwear system of claim 3, wherein the plurality of decorative elements is a set of decorative elements having a first theme, the system further comprising a second set of decorative elements having a second theme, wherein the second set of decorative elements are operable to be attached to the exterior area of the fabric cap head covering, and to replace the first set of decorative elements to change the appearance of the fabric cap head covering.

5. The headwear system of claim 1, wherein the magnet array layer is a foam holding the first, second and third magnets.

6. The headwear system of claim 5, wherein the backing layer is selected from the group consisting of neoprene, rubber, silicone, and felt.

7. The headwear system of claim 1, wherein the solid sealing layer is selected from the group consisting of a heat transfer vinyl, a decorative vinyl, or a plastic sheet material.

8. The headwear system of claim 1, wherein the ferrous material is a flexible sheet or infused layer of fabric, rubber, or flexible metal.

9. The headwear system of claim 1, wherein the decorative element is a patch at a front of the fabric cap head covering.

10. The headwear system of claim 1, wherein the securing mechanism includes a sweat band.

11. The headwear system of claim 1, wherein the solid sealing layer and the backing layer have non-adhesive surfaces in contact with the interior of the pouch.

12. A cap with a selectable appearance comprising:

a fabric material having an exterior surface and an interior surface;

an interior pouch attached to the interior surface, the interior pouch having an open end;

a utility belt having a solid sealing layer, a backing layer and a magnet array layer between the solid sealing and backing layers, the magnet array layer holding a plurality of magnets arranged in a pattern, the utility belt inserted in the open end of the interior pouch on the bottom of a side and a front of the cap;

a first decorative element having a ferrous material, the first decorative element being attachable on the exterior surface of the fabric material on the side or the front of the cap to any one of the plurality of magnets.

13. The cap of claim 12, further comprising a second decorative element having a ferrous material attached to the front of the cap via one of the plurality of magnets.

14. The cap of claim 13, wherein the first and second decorative elements have a first theme, the system further comprising a third decorative element and a fourth decorative element having a common second theme, the third decorative element operable to replace the first decorative element, and the fourth decorative element operable to replace the second decorative element to change the appearance of the cap.

15. The cap of claim 13, wherein the interior pouch is a sweat band.

* * * * *